US005950064A

United States Patent [19]

Robinson et al.

[11] Patent Number: 5,950,064

[45] **Date of Patent: *Sep. 7, 1999**

[54] LEAD-FREE SHOT FORMED BY LIQUID PHASE BONDING

[75] Inventors: Peter W. Robinson, Branford; Brian Mravic, North Haven; Derek E. Tyler, Cheshire, all of Conn.

[73] Assignee: Olin Corporation, New Haven, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/785,453

[22] Filed: Jan. 17, 1997

[51] Int. Cl.[6] ..... B22F 3/12

[52] U.S. Cl. ..... 419/47; 419/18; 419/28; 419/38

[58] Field of Search ..... 419/18, 28, 38, 419/41, 47; 75/228, 240; 102/506, 517

[56] References Cited

U.S. PATENT DOCUMENTS

| | | | |
|---|---|---|---|
| 4,027,594 | 6/1977 | Olin et al. | 102/92.4 |
| 4,428,295 | 1/1984 | Urs | 102/448 |
| 4,881,465 | 11/1989 | Hooper et al. | 102/501 |
| 4,949,645 | 8/1990 | Hayward et al. | 102/517 |
| 5,088,415 | 2/1992 | Huffman et al. | 102/515 |
| 5,189,252 | 2/1993 | Huffman et al. | 102/459 |
| 5,237,930 | 8/1993 | Bélanger et al. | 102/529 |
| 5,264,022 | 11/1993 | Haygarth et al. | 75/255 |
| 5,279,787 | 1/1994 | Oltrogge | 419/38 |
| 5,399,187 | 3/1995 | Mravic et al. | 75/228 |
| 5,500,183 | 3/1996 | Noordegraaf et al. | 420/557 |

FOREIGN PATENT DOCUMENTS

WO 94/24511 10/1994 WIPO .

OTHER PUBLICATIONS

Metals Handbook® Ninth Edition, American Society for Metals, vol. 7, Powder Metallurgy at pp. 319–321 (1988).

Glossary of Metallurgical Terms and Engineering Tables, American Society for Metals, p. 65. (1979).

Mary–Jacque Mann et al. "Shot Pellets: An Overview" appearing in *AFTE Journal* (vol. 26, No. 3) (Jul. 1994) pp. 223–241.

Bruce Warren and Bill Stevens, technical paper entitled Application for U.S. Fish and Wildlife Service Review and Approval of Tungsten–Iron Shot as Nontoxic Shot, prepared for Federal Cartridge Company, Anoka, MN. (1996).

*Primary Examiner*—Daniel J. Jenkins

*Attorney, Agent, or Firm*—Gregory S. Rosenblatt; Wiggin & Dana

[57] ABSTRACT

There is provided a lead-free projectile, such as a bullet or a ballistic shot, formed by liquid phase sintering or liquid phase bonding of a first particulate having a density greater than lead, a second, ductile, particulate having a melting temperature in excess of 400° C. and a binder having a fluidity temperature that is less than the melting temperature of the second particulate. Unlike solid phase sintering that tends to produce articles having a porosity of about 20%, by volume, liquid phase sintering and liquid phase bonding achieve close to 0% porosity. Reducing the porosity level decreases the amount of high density, first particulate, required to achieve a density close to that of lead. Since the high density particulate tends to be the most expensive component of the projectile, this significantly reduces the cost of the projectile. The reduced porosity also allows for an increase in the amount of the second, ductile, component. Increased ductility generates a projectile with a reduced likelihood of fragmentation on being fired from a weapon and with better deformation on impact with a target. One suitable composition for the projectile is ferrotungten-iron-zinc.

12 Claims, 6 Drawing Sheets

LEAD-FREE SHOT FORMED BY LIQUID PHASE BONDING

BACKGROUND OF THE INVENTION

1. Field of the Invention

This invention relates to lead-free projectiles, such as ballistic shot. More particularly, projectiles having a density approximating that of lead are formed by liquid phase sintering or liquid phase bonding.

2. Description of Related Art

Lead is the historic material of choice for projectiles such as bullets and ballistic shot. Lead is a very dense material having a room temperature density of 11.35 grams per cubic centimeter (g/cm$^3$) where room temperature is nominally 20° C. The high density enables lead-based projectiles to maintain a higher kinetic energy and more accurate flight pattern over long distances than less dense materials.

Lead is an environmentally undesirable material, particularly when the shot is fired over waterways and wetlands. A need exists for a projectile that is lead-free and environmentally acceptable.

One lead-free shot combines a material with a density greater than that of lead with a second, lower density, material in a proportion effective to achieve a density approximating that of lead. U.S. Pat. No. 5,399,187 by Mravic et al. discloses a sintered mix of powders having a high density component selected from the group tungsten, tungsten carbide and ferrotungsten and a more ductile, lower density component selected from the group tin, bismuth, zinc, iron, aluminum and copper. The powders are blended together, formed into a desired shape, compacted and sintered.

Solid phase sintering, as defined by the American Society for Metals, involves the bonding of adjacent surfaces in a mass of particles by molecular or atomic attraction on heating at high temperatures below the melting temperature of any constituent in the material. No matter how much compaction pressure is applied or how long the sintering time, it is difficult, when tungsten or ferrotungsten is a constituent of the powder blend, to achieve 100% of the theoretical density by sintering. A significant volume, on the order of 20% by volume, of the compacted mass is voids or porosity, thereby reducing the density of the sintered projectile.

One way to achieve 100% of the theoretical density is to form a homogeneous molten alloy of a higher density metal and a lower density metal. U.S. Pat. No. 5,264,022 to Haygarth et al. discloses a mixture of iron and 30%–45%, by weight, of tungsten, that is heated to a temperature of between 1650° C. and 1700° C. The molten alloy is then poured through a shot tower. While effective to generate a projectile having 100% of the theoretical density, the energy required to heat the tungsten/iron alloy to the melting point is prohibitive.

Another approach is to suspend the dense particulate, that typically has a very high melting temperature, in a molten bath of a lower melting temperature metal or metallic alloy. U.S. Pat. No. 4,881,465 to Hooper et al. discloses shot formed by suspending iron-ferrotungsten particulate, in a molten bath of a low melting temperature (under 300° C.) lead-tin-antimony alloy. Approximately 25%–50%, by weight, of the mixture is the low melting alloy.

U.S. Pat. No. 5,189,252 to Huffman et al. discloses shot formed by suspending a dense particulate, such as tungsten or depleted uranium, in a liquid metal bath that is typically tin.

U.S. Pat. No. 5,279,787 to Oltrogge discloses shot formed by suspending a dense particulate, such as tungsten or tantalum, in a liquid metal bath that is tin, bismuth or an alloy such as bismuth-tin, bismuth-antimony, bismuth-zinc and tin-zinc. From about 11% to in excess of 60%, by weight, of the shot is the lower melting constituent. The Oltrogge patent discloses a counter-flow crucible for forming the molten suspension because the dense particulate settle from the molten bath and tend to form shot with an anisotropic density distribution. If the shot lacks uniform density, irregular shot patterns and unpredictable performance result.

It is also known to suspend a dense particulate, such as tungsten in a polymer matrix, such as polyethylene or a silicone rubber as disclosed in U.S. Pat. No. 4,949,645 to Hayward et al.

There exists, therefore, a need for lead-free shot and a method for the manufacture thereof that does not have the manufacturing problems of the prior art.

SUMMARY OF THE INVENTION

It is an object of the invention to provide a lead-free projectile having reduced porosity when compared to sintered projectiles. It is a feature of the invention that the reduced porosity is achieved through liquid phase sintering or by liquid phase bonding. By maintaining the constituent of the projectile that forms the liquid phase to less than 10%, by weight, settling of the dense constituent and an anisotropic density distribution are avoided.

It is an advantage of the invention that lead-free projectiles, such as bullets and ballistic shot, are formed with a density similar to that of lead. The projectiles have reduced porosity, porosity approaching 0% by volume, when compared to sintered projectiles. Reduced porosity permits the inclusion of a higher proportion of a ductile constituent into the projectile, increasing both formability during manufacture and deformability on impact with a target. A further advantage of reduced porosity is that the amount of the dense constituent required is reduced. Since the dense constituent tends to be more costly, this reduces the cost of the projectile.

A second objective of the invention is to provide a method for the manufacture of projectiles. It is a feature of the invention that a projectile preform is formed by either a batch or continuous process and then mechanically formed into a desired shape. It is another feature of the invention that the processes employ liquid phase sintering utilizing a limited volume of a liquid phase.

It is an advantage of the invention that these processes achieve a homogeneous dispersion of particulate and the density of projectiles remains fairly constant. An advantage of uniform density from one projectile to the next is that more uniform performance is achieved when the projectile is fired.

In accordance with the invention, there is provided a projectile for discharge from a weapon. The projectile comprises an integral mass of particulate having a desired shape and a density in excess of 9.8 g/cm$^3$. The integral mass contains a first particulate component that has a room temperature density that is greater than 11.35 g/cm$^3$, a second particulate component that has a melting temperature in excess of 400° C. and a binder. The binder disposed between and bound to the first and second particulate components. The binder is a third component that has a fluidity temperature that is less than the melting temperature of both the first and the second components. By fluidity temperature, it is meant the temperature above which the third component is sufficiently fluid to flow readily between the first and second components. For example, when the third component is a metal, the fluidity temperature is equal to the liquidus temperature. Preferably, the viscosity of the fluid, at a desired processing temperature, is less than about 10 centipoise. This third component is present in an amount effective to bind the first and second components, but less than 10%, by weight, of the integral mass.

A first method for the manufacture of the projectile includes the steps of blending a mixture of a first particulate, a second particulate and a third particulate where the first particulate has a room temperature density in excess of 11.35 g/cm$^3$, the second particulate has a melting temperature above 400° C. and the third particulate has a fluidity temperature less than the melting temperature of both the first and the second particulate. The third component is present in an amount effective to bind the first and second particulate, but less than 10%, by weight, of the mixture. The mixture is then compacted into a mold of a desired shape and then heated to a temperature greater than the fluidity temperature of the third particulate, but below the melting temperature of the second particulate, for a time effective to densify and consolidate the mixture into a preform. This preform is then mechanically formed into a desired projectile shape.

A second method of manufacture includes the same blending step, but the mixture is then delivered to a first chamber having a first through passageway of a first cross-sectional area and an open front end. The mixture is then continuously extruded through the open front end to a second chamber that has a second through passageway of a second cross sectional area with the second cross-sectional area being less than the first cross-sectional area. The mixture is then heated to a temperature greater than the fluidity temperature of the third particulate, but below the melting temperature of the second particulate for a time effective to densify and consolidate the mixture into a rod. This rod is then mechanically formed into the projectile.

The above stated objects, features and advantages will become more apparent from the specification and drawings that follow.

IN THE DRAWINGS

Figure 7:
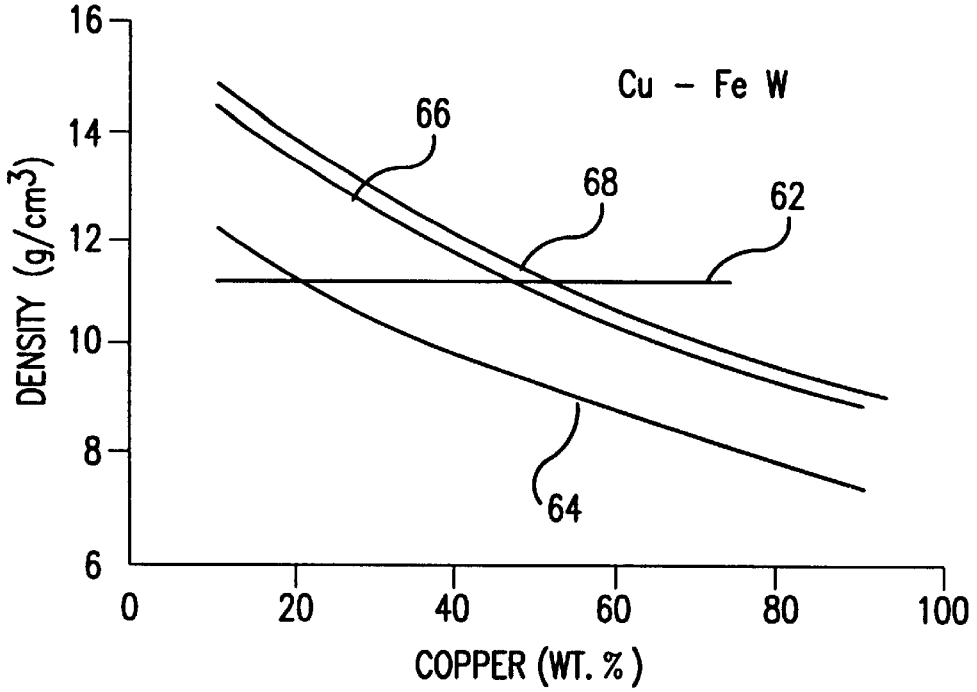
Figure 8:
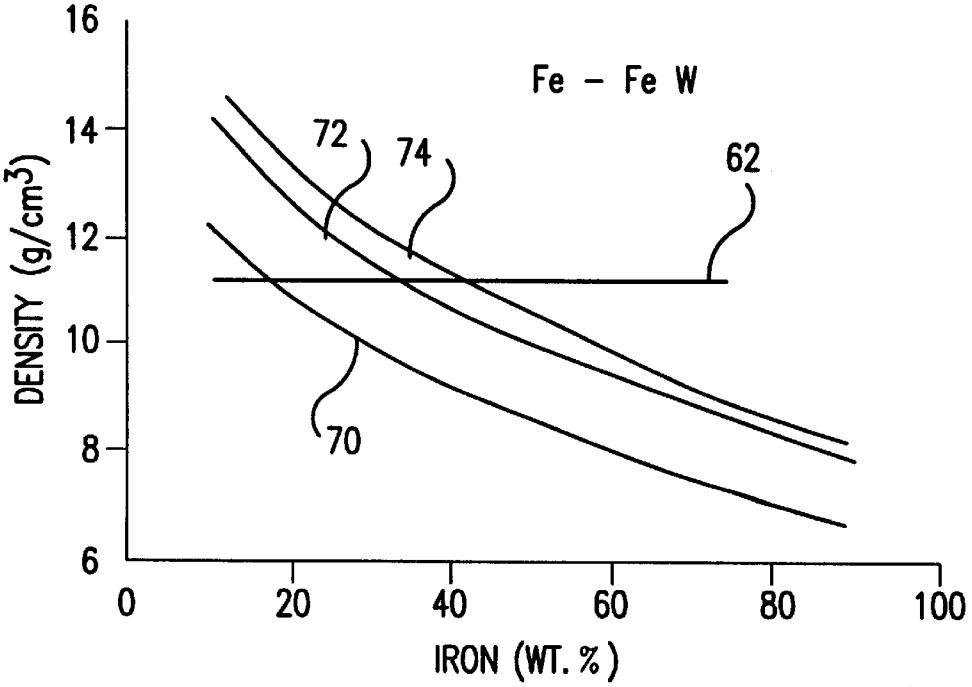

FIGS. 7 and 8 graphically illustrate an advantage of the method of the invention when a particulate constituent is ferrotungsten.

Figure 9:
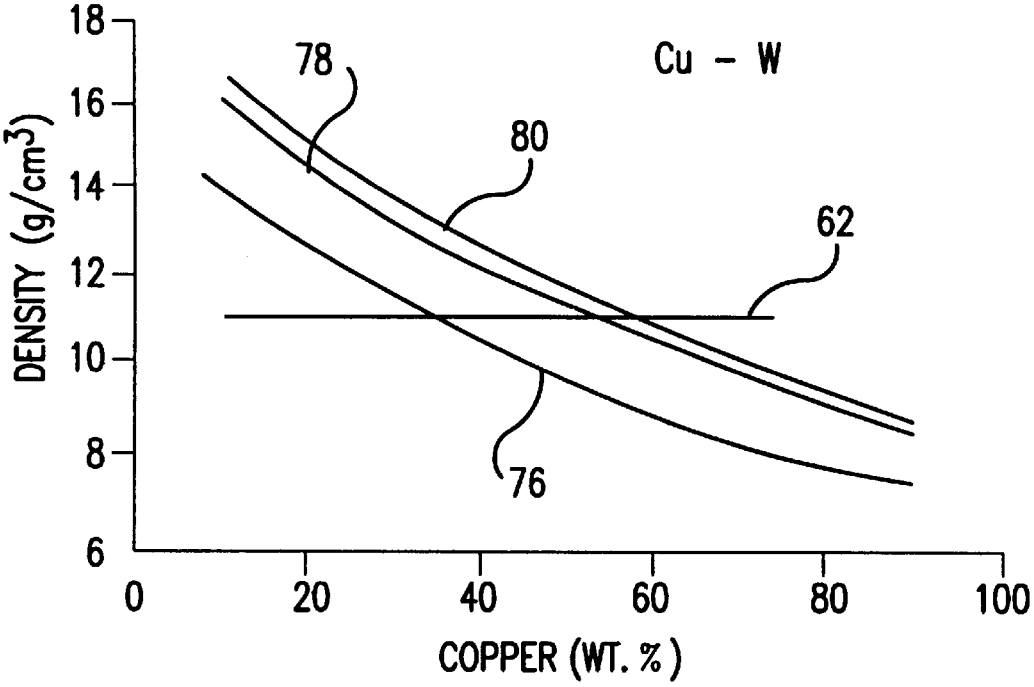
Figure 10:
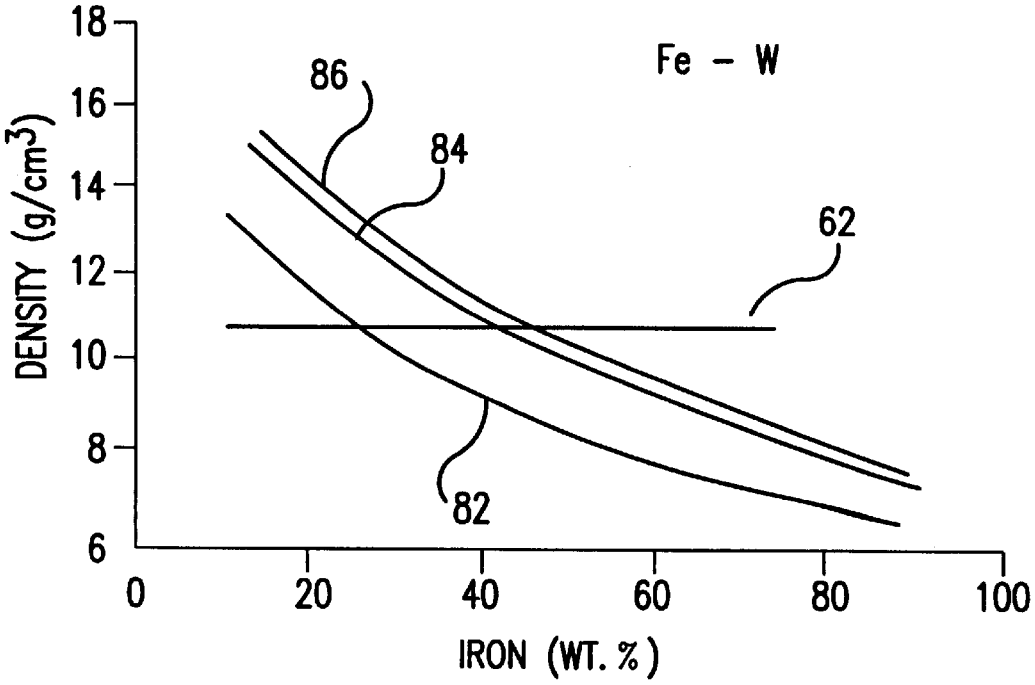

FIGS. 9 and 10 graphically illustrate an advantage of the method of the invention when a particulate constituent is tungsten.

Figure 11:
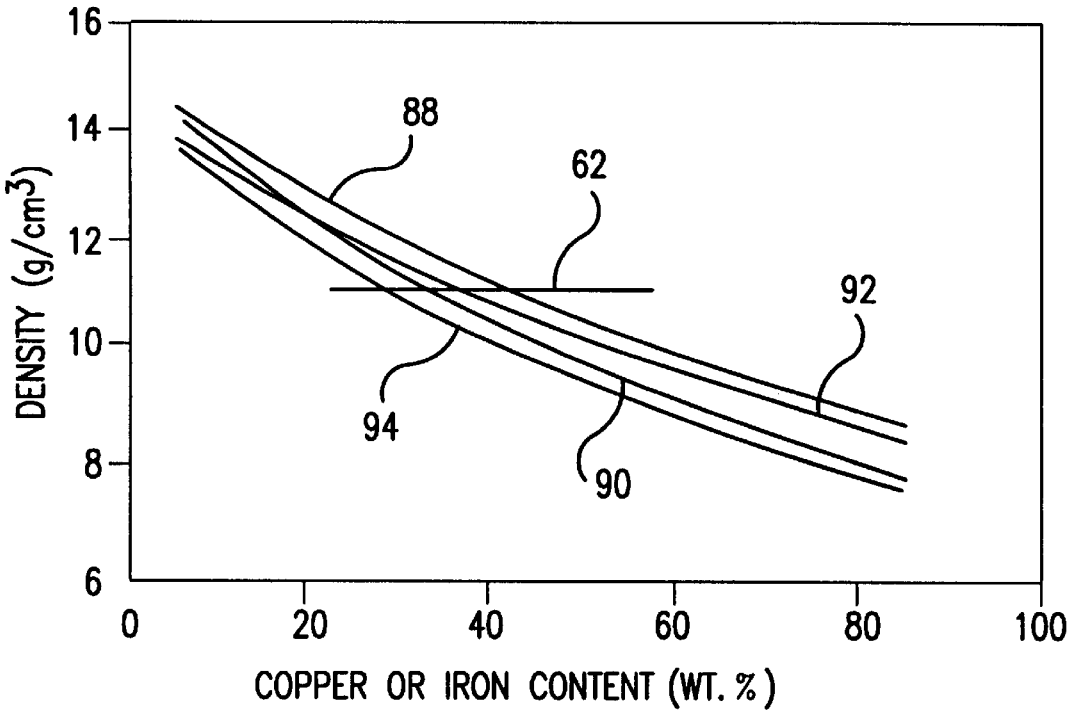
Figure 12:
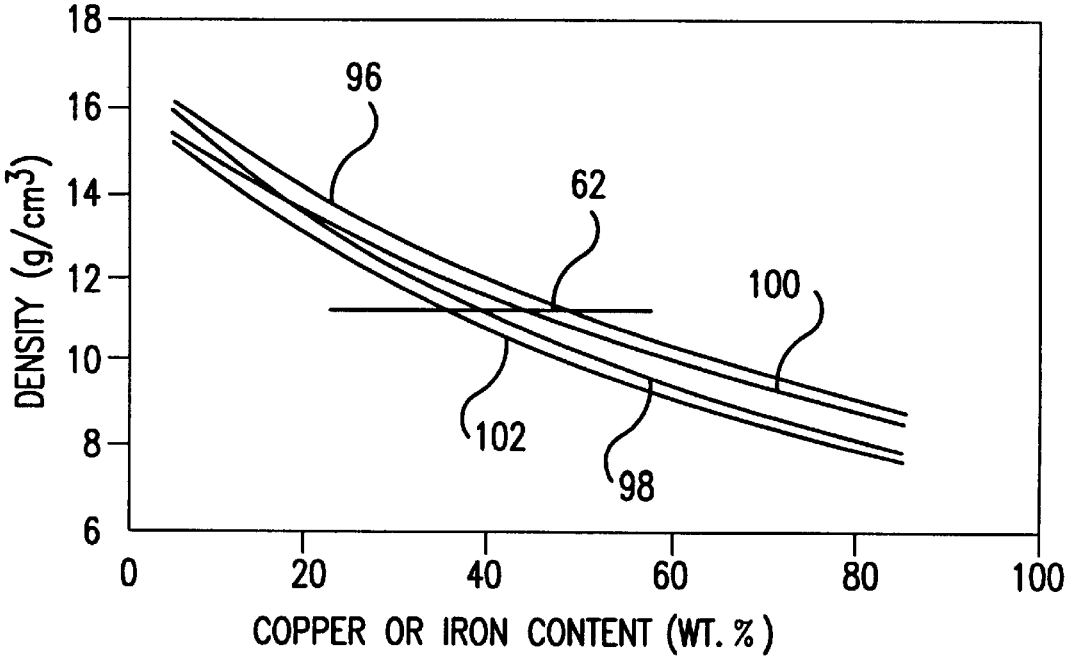

FIGS. 11 and 12 graphically illustrate an advantage of the method of the invention when the binder is non-metallic.

DETAILED DESCRIPTION

The method of the invention is suitable for the manufacture of any projectile that is discharged from a weapon. The projectile is intended to have a density that is at least about equal to or greater than 9.8 g/cm$^3$,the density of bismuth, and typically the density is about 11.35 g/cm$^3$, the density of lead. In one embodiment, the density is greater than that of lead for enhanced stopping power. In this embodiment, the density is between 12 g/cm$^3$ and 14 g/cm$^3$.

Preferably, the projectiles of the invention have a density of between 10 g/cm$^3$ and 13 g/cm$^3$ and most preferably, the density is between 11 g/cm$^3$ and 13 g/cm$^3$, with all densities being at room temperature. Typical projectiles include ballistic shot, bullets, penetrator rods and flechettes.

Figure 1:
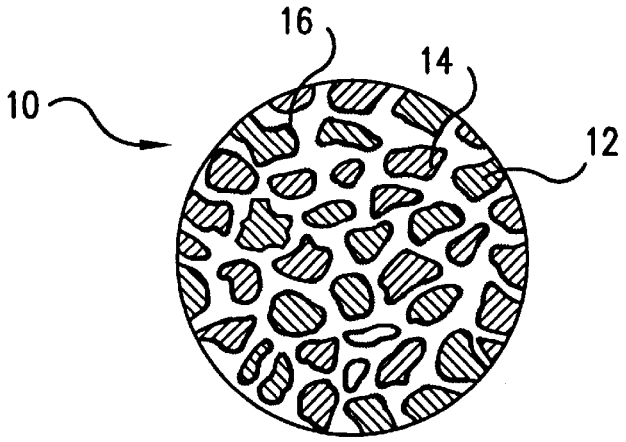
FIG. 1 shows in cross-sectional representation a ballistic shot formed in accordance with the invention.

FIG. 1 illustrates in cross-sectional representation a ballistic shot 10 formed in accordance with the invention. The ballistic shot 10 is an integral mass of particulate sufficiently bonded together to perform as a single device. While the ballistic shot will deform and may fracture on impact with a target, the ballistic shot may be deformed, but remains intact when discharged from the weapon.

The ballistic shot 10 contains a first particulate 12 that has a density greater than 10 g/cm$^3$. Suitable materials for the first particulate include ferrotungsten, tungsten carbide, tungsten and other tungsten alloys. Other suitable materials for the first particulate component include tantalum, depleted uranium, molybdenum and alloys thereof. Materials consisting materially of these metals, such as oxides, carbides and nitrides may also be used.

Ferrotungsten (typically 70%–80%, by weight, tungsten and the balance iron) and other iron-tungsten alloys are most preferred due to a relatively low cost when compared to tungsten metals and other tungsten base alloys. Ferrotungsten is also ferromagnetic, facilitating environmental cleanup with magnets.

Dispersed among the first particulate 12 is a second particulate 14 that has a melting temperature in excess of about 400° C., and preferably in excess of about 500° C,. and is ductile. By ductile it is meant that at room temperature the second particulate can be deformed (elongated or compressed) under either tensile or compressive stresses by more than 20% by length, without fracture. Suitable materials for the second particulate include zinc, iron, copper and alloys thereof. The higher the proportion of ductile constituents in the projectile, the less likely the projectile will fracture during discharge from a weapon and the more likely the projectile will deform on impact with a target. Deformation on impact with a target is desirable to disperse the kinetic energy of the projectile and to avoid penetration of a bullet-proof vest. Preferably, the projectile includes at least 40%, by weight, of ductile constituents.

A binder 16 is disposed between and bound to the first particulate 12 and second particulate 14. The binder 16 is either a third component or an alloy of that third component and at least one of either the first particulate component and the second particulate component. The third component can be a metal, polymer, glass, or mixture thereof.

When the third component is a metal it has a liquidus temperature less than the melting temperature of either the first component or of the second component. Preferably, the liquidus temperature of the third component is less than 500° C. Preferred third components include tin, zinc, bismuth, antimony or an alloy thereof.

When the third component is a glass or a polymer, it has a fluidity temperature, $T_f$, of less than the melting temperature of either the first component or of the second component. Preferably, $T_f$, defined as the temperature above which the glass or polymer acts primarily as a low viscosity liquid rather than a solid or elastomeric material is less than 500° C. When the third component is a polymer, it is preferred that the second component have a density of less than 10 g/cm$^3$ so that the composite shot has a density close to that of lead. Suitable materials with a density of less than 10 g/cm$^3$ include copper, iron and alloys thereof.

Typical polymers suitable as the third component include epoxies, polyuretanes, polypropylene and polyethylene. Typical glasses suitable as the third component include soda lime glass.

To minimize setting of the first particulate 12 and the second particulate 14 in the third component, when the third component is in a liquid state, the third component is present in an amount of less than 10%, by weight, of the integral mass. However, a sufficient amount of the third component must be present to bond to the first and second components. Typically, the third component is present in an amount of from 3% to 7%, by weight. When liquid, the third component surrounds and mechanically fixes the first particulate 12 and second particulate 14. Preferably, when liquid, the third component chemically reacts with either the first component 12, the second component 14, or with oxide layers thereon to form an alloy or a chemical bond therebetween.

As an example, zinc melts at 420° C. and would dissolve a portion of iron from the particulate to form an intermetallic compound alloy with the iron that would then resolidify.

When the third constituent is a metal or a metallic alloy, if a portion of the binder 16 remains liquid at the processing temperature, then the process is referred to as liquid phase sintering. If all of the binder has a melting temperature above the processing temperature and none of the binder remains molten at the processing temperature, then the process is referred to as transient liquid phase sintering.

Table 1 illustrates an advantage of liquid phase sintering with close to 0% by volume of porosity as compared to solid phase sintering that typically has about 20% by volume of porosity. The weight percent of the first particulate, FeW or W, required to achieve a density equal to that of lead is reduced from about 75% to about 50%. Since the first particulate tends to be the most expensive constituent of the projectile, this reduction constitutes a significant cost saving.

TABLE 1

Composition to Achieve the Same Density as Lead

| PROCESS | COMPOSITION(wt. %) | DUCTILE CONENT* Weight % | DUCTILE CONENT* Volume % |
|---|---|---|---|
| Solid Phase Sintering | 20.9CU-79.9FeW | 20.9 | 26.5 |
| | 16.2Fe-83.8FeW | 16.2 | 23.3 |
| | 31.4Cu-68.6W | 31.4 | 39.8 |
| | 25.0Fe-75.0W | 25.0 | 36.0 |
| Liquid Phase Sintering | 47.3Cu-47.7FeW-5Sn | 52.3 | 67.8 |
| | 47.0Cu-48.0FeW-5Zn | 52.0 | 67.6 |
| | 50.6Cu-44.4FeW-5Bi | 50.6 | 64.2 |
| | 36.6Fe-58.4FeW-5Sn | 41.6 | 60.5 |
| | 36.2Fe-58.8FeW-5Zn | 41.2 | 60.4 |
| | 39.2Fe-55.8FeW-5Bi | 39.2 | 56.5 |
| | 53.6Cu-41.4W-5Sn | 58.6 | 75.7 |
| | 53.3Cu-41.7W-5Zn | 58.3 | 75.6 |
| | 56.5Cu-38.5W-5Bi | 56.5 | 71.7 |
| | 42.8Fe-52.2W-5Sn | 47.8 | 69.4 |
| | 42.6Fe-52.4W-5Zn | 47.6 | 69.3 |

TABLE 1-continued

Composition to Achieve the Same Density as Lead

| PROCESS | COMPOSITION(wt. %) | DUCTILE CONENT* Weight % | DUCTILE CONENT* Volume % |
|---|---|---|---|
| | 45.1Fe-49.9W-5Bi | 45.1 | 65.0 |
| | 35.9Cu-63.1FeW-1HDPE | 36.9 | 57.3 |
| Liquid Phase Bonding | 27.8Fe-71.2FeW-1HDPE | 28.8 | 51.9 |
| | 44.2Cu-54.8W-1HDPE | 45.2 | 67.9 |
| | 35.3Fe-63.7W-1HDPE | 36.3 | 62.7 |
| | 44.5Cu-56.5FeW-2GL | 41.5 | 52.6 |
| | 32.1Fe-65.9FeW-2GL | 32.1 | 46.3 |
| | 48.9Cu-49.1W-2GL | 48.9 | 62.0 |
| | 39.1Fe-58.9W-2GL | 39.1 | 56.3 |

*This column reflects the total amount of ductile constituents in the composites; i.e. the sum of copper, iron, tin, zinc and HDPE. It does not include the brittle constituents which are ferrotungsten, tungsten, bismuth and glass.
HDPE = high density polyethylene, $T_f \approx 250°$ C.
GL = soda lime glass, $T_f \approx 1000°$ C.

From Table 1, the following are preferred compositions, in weight percent, when the projectile is to have a density similar to that of lead:

ferrotungsten about 45%–70%;

copper about 35%–50%; and the balance a third component effective as a binder selected from the group consisting of tin, zinc, bismuth and alloys thereof, glasses and polymers.

Ferrotungsten about 55%–70%;

iron about 30%–45%; and the balance a third component effective as a binder selected from the group consisting of tin, zinc, bismuth and alloys thereof, glasses and polymers.

Tungsten about 39%–55%;

copper about 44%–57%; and the balance a third component effective as a binder selected from the group consisting of tin, zinc, bismuth and alloys thereof, glasses and polymers.

Tungsten about 50%–64%;

iron about 35%–45%; and the balance a third component effective as a binder selected from the group consisting of tin, zinc, bismuth and alloys thereof, glasses and polymers.

Figure 2:
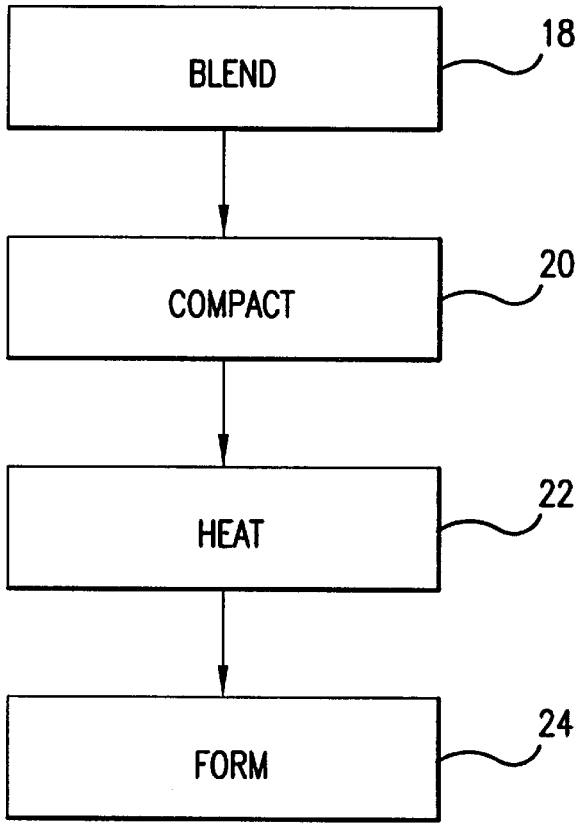
FIG. 2 is block diagram of a first method for the manufacture of the projectiles of the invention.

A first method for the manufacture of the projectiles is illustrated in block diagram in FIG. 2. A particulate mixture of first component, second component and third component are blended 18 together to form a homogeneous mixture. Typically, the first particulate will have a maximum axial length of between about 1 and 1000 microns and preferably and between about 3 and 500 microns. The second particulate will have a maximum axial length of between about 1 and 500 microns and preferably between about 20 and 200 microns and the third particulate will have a maximum axial length of between about 1 and 500 micron and preferably between about 20 and 200 microns.

The homogeneous mixture is then compacted 20 in a mold of a desired shape. The mold may have the shape of the projectile, such as an ogival shaped bullet, a penetrator rod or a spherical ballistic shot. Alternatively the mold has the shape of an intermediate preform such as a cylindrical billet.

The compacted mixture is then heated 22 to a temperature greater than the fluidity temperature of the third particulate, but less than the melting temperature of the second particulate. Typically metallic third components and their melting temperatures are:

| | |
|---|---|
| Tin | 232° C. |
| Zinc | 420° C. |
| Bismuth | 271° C. |

Typical melting temperatures for the second particulate are:

| | |
|---|---|
| Copper | 1085° C. |
| Iron | 1538° C. |

A temperature of between about 300° C. and 500° C. is effective for the heating step 22 when the third component is tin or bismuth. A temperature range of about 450° C.–600° C. is effective when the third component is zinc.

The mixture is held at temperature for a time effective to density and consolidate the mixture into a preform. For transient liquid phase sintering, this is a time effective for all of the third component to alloy with the first or second component and to solidify. For liquid phase sintering or bonding. this is a time effective for the molten third component to surround and, if applicable, chemically react with the first and second components. Typically, this time is on the order of from about 0.1 to about 10 minutes.

The densified mixture is then cooled and the preform formed 24 into the finished shape of a projectile. If the mold has a desired shape close to the shape of the projectile, near net-shape, the forming step 24 may require little more than chemical or mechanical polishing to remove residual flash and to round off sharp corners. If, the mold forms an intermediate preform, such as a rod, the preform is then cut to pieces of a desired length that are mechanically formed into the projectile. For example, the rod is typically sliced into cylindrical components that are mechanically deformed, such as by swaging, into spherical ballistic shot.

Figure 3:
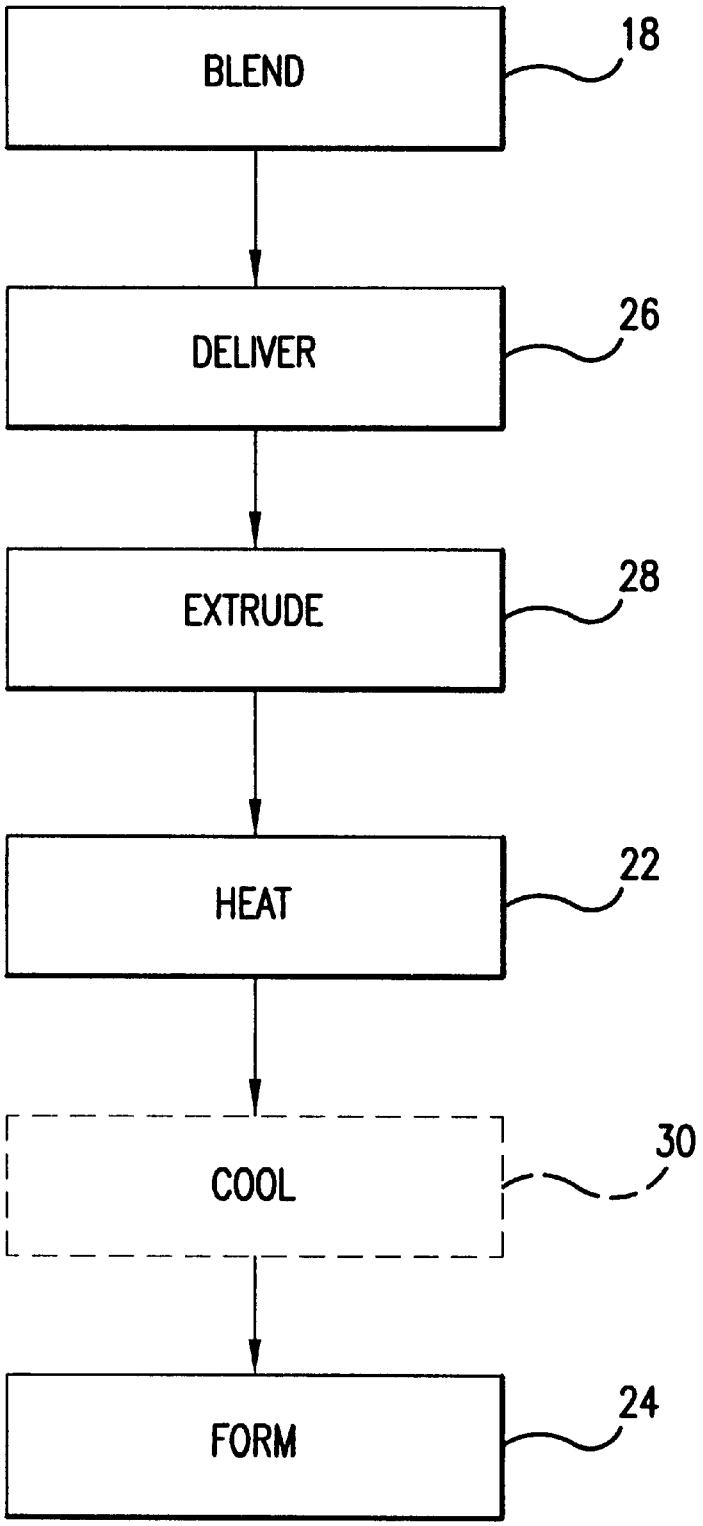
FIG. 3 is block diagram of a second method for the manufacture of the projectiles of the invention.

Rather than the batch process illustrated in FIG. 2, a continuous process, as illustrated in block diagram in FIG. 3, may also be used. First particulate, second particulate and third particulate are blended 18 together as described above. The blended mixture is then delivered 26 to a first chamber having a first through passageway of a first cross-sectional area and an open front end. The mixture is continuously extruded 28 through the open front end to a second chamber that has a second through passageway of a second cross-sectional area. The second cross-sectional area is less than the first cross-sectional area, preferably by from about 20% to 80%, by area and most preferably by from about 40% to 60%, by area. This reduction in cross-sectional area effectively consolidates the mixture of powders.

In the second chamber, the mixture is heated 22 to a temperature effective to render fluid the third particulate, but below the melting temperature of either the first or second particulate. The length of the second chamber is that necessary to maintain the mixture at an elevated temperature for a time effective to densify and consolidate the mixture into a rod. Preferably, this time is from about 1 to about 15 seconds.

If transient liquid phase sintering is utilized, the rod is then cut into preforms of a desired size and mechanically formed 24 into projectiles. If liquid phase sintering or bonding is employed, a cooling step 30 is interposed between the heating step 22 and the forming step 24 to ensure that the rod has been consolidated to an integral mass.

Figure 4:
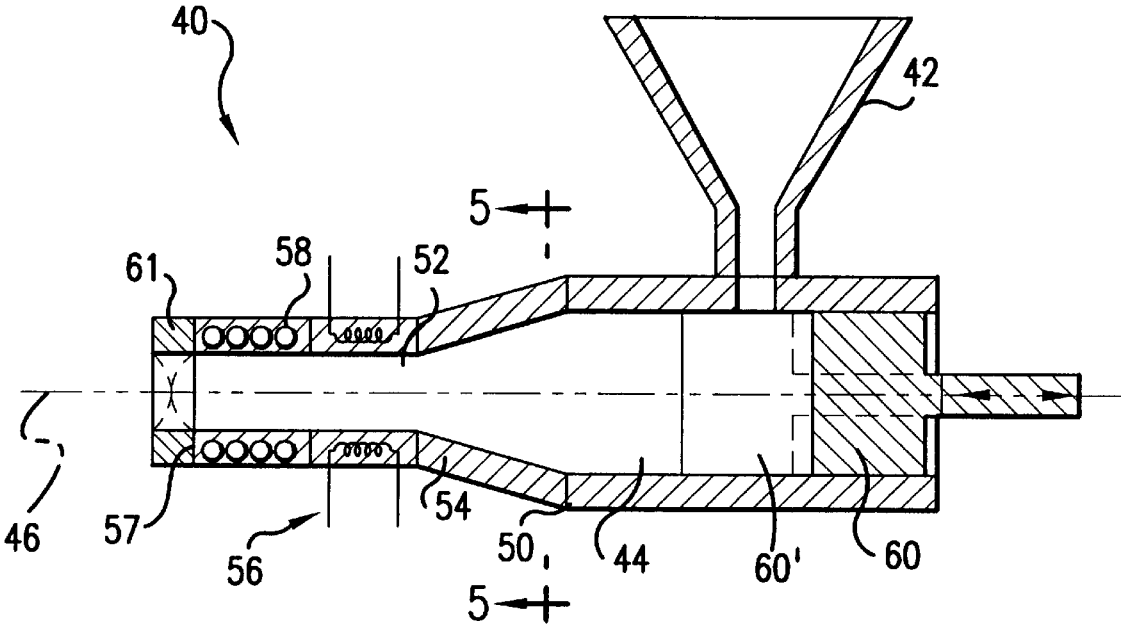
FIG. 4 is a cross-sectional representation of an apparatus for the manufacture of projectiles according to the method illustrated in FIG. 3.
Figure 5:
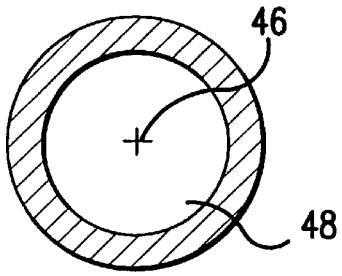
FIG. 5 is a cross-sectional representation of a chamber portion of the apparatus of FIG. 4.

FIG. 4 illustrates in cross-sectional representation an apparatus 40 for manufacturing the rod utilized in the continuous process illustrated in FIG. 3. The apparatus 40 has a powder hopper 42 for introducing the blended mixture of particulate to the first chamber 44. When viewed along longitudinal axis 46, the first chamber 44 has a first through passageway of a first cross tonal area 48. While a circular cross-sectional area is illustrated in FIG. 5, other cross-sectional shapes such as squares, rectangles, and other polyhedrons may also be utilized The cross-sectional shape 48 is selected to minimize the degree of mechanical forming required to manufacture the projectile.

Referring back to FIG. 4, the powder mixture is extruded through an open front end 50of the first chamber 44 to a second chamber 52 having a second through passageway of a second cross-sectional area that is less than the cross-sectional area 48 of the first chamber. While the second cross-sectional area may be of any desired shape, to facilitate continuous transfer of blended powders, the cross-sectional shape of the second chamber is preferably the same shape, although of smaller size, than the first chamber. Additionally, a tapered transition zone 54 is preferably disposed between the first chamber 44 and second chamber 52.

The second chamber 52 includes heaters 56 to raise the temperature of the mixture to a temperature greater than the fluidity temperature of the third particulate, but below the melting temperature of the second particulate for a time effective to densify and consolidate the mixture into a rod. If transient liquid phase sintering is employed, then the rod is continuously extruded from an end 57 of the apparatus 40 and the moving rod cut into desired lengths by a flying saw.

If liquid phase sintering or bonding is employed, a cooling zone 58 such as tubes containing a circulating coolant such as water, is appended to the second chamber 52 to cool the consolidated mixture to a temperature effective to form the rod as an integral mass.

Movement of the powders through the apparatus 40 is effected by any suitable means. As illustrated in FIG. 4, a reciprocating ram 60 cycles between a rear position and a forward position 60', forcing the powders forward into the transition zone 54 and second chamber 52. The reciprocating ram 60 then moves back to the first position to allow more of the blended powder mix to fall from the powder hopper 42 into the first chamber 44 Typically, the ram reciprocates between positions 60 and 60' on the order of about 4 to 60 times per minute.

Alternatively, rather than a powder hopper 42 and reciprocating ram 60, a continuous feed mechanism such as an auger screw, as typically used to extrude polymers, may also be employed.

Figure 6:
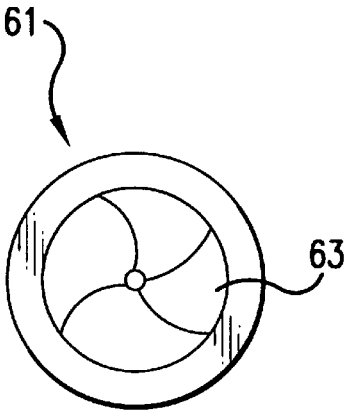
FIG. 6 illustrates in front planar view a cutting die for the apparatus illustrated in FIG. 4.

In another alternative, a cutting die 61 is mounted to the end 57 of the apparatus 40. The cutting die, illustrated in front planar view in FIG. 6, has a segmented diaphragm 63 that cyclically opens and closes partitioning the extruded rod into segmented pellets. Movement of the segmented diaphragm may be mechanically, electrically or electronically actuated. Particularly when the third constituent is still partially liquid, the force necessary to partition the rod is minimal. Any suitable means may be used to cut the rod to a desired size and shape. Such means include shearing with a rotating blade, a scissors and by passing through a set of textured metal rolls.

The advantages of the liquid phase sintering methods of the invention will become more apparent from the examples that follow.

EXAMPLES

Based on the assumption that solid phase sintering results in a porosity of about 20% by volume and that liquid phase sintering achieves 0% porosity, the density of a sintered mass as a function of the amount of copper necessary to achieve a density equal to that of lead in a copper-ferrotungsten composite was calculated and is graphically illustrated in FIG. 7. Reference line 62 identifies the density of lead, 11.35 g/cm$^3$. Reference line 64 shows that for solid phase sintered Cu-FeW, less than 20%, by weight, of the integral mass can be copper while the remainder must be ferrotungsten. This ratio significantly increases the cost of the projectile and reduces the ductility.

Reference line 66 illustrates that for a liquid phase sintered projectile containing 5%, by weight, of either tin or zinc, a copper content of about 45%, by weight, is required, reducing the weight percent contribution of the ferrotungsten to less than 50%. Even less ferrotungsten is required when the third particulate is bismuth, as illustrated by reference line 68. However, since bismuth is brittle, unlike tin and zinc, bismuth does not contribute to the ductility of the projectile.

FIG. 8 graphically illustrates that a similar increase in the amount of iron required is achieved when the projectile has ferrotungsten as the first component and iron as the second component. Only about 15%, by weight, of iron may be present when solid phase sintering is employed as illustrated by reference line 70 In excess of 30% iron may be employed when liquid phase sintering is utilized with 5% tin or zinc as illustrated by reference line 72. In excess of 40% of iron may be utilized when liquid phase sintering is employed with 5% bismuth as illustrated by reference line 74.

In FIG. 9, reference line 76 shows that for solid phase sintering of a copper/tungsten particulate mix, the maximum copper content is about 35%, by weight, to achieve a density equal to that of lead. With liquid phase sintering, a copper content in excess of about 45% is obtained when the third component is 5% tin or zinc, reference line 78. The copper content approaches 50%, by weight, when the third component is bismuth, reference line 80.

FIG. 10 graphically illustrates the iron content for an iron/tungsten particulate mix is a maximum of about 22% when solid phase sintering is employed, reference line 82 The iron content exceeds 35%, by weight, when liquid phase sintering is employed with 5% tin or zinc, reference line 84 or 5% bismuth, reference line 86.

FIG. 11 graphically illustrates the iron and the copper content for a ductile metal/ferrotungsten mix when the binder is non-metallic. Reference line 88 illustrates that for Cu—FeW—2% (by weight) glass, in excess of about 40% copper may be present while reference line 90 illustrates that when the ductile component is iron, in excess of about 35% iron may be present. Reference line 92 illustrates that for Cu—FeW—1% HDPE (by weight), in excess of about 37% copper may be present while reference line 94 illustrates that when the ductile component is iron, in excess of about 30% iron may be present.

FIG. 12 graphically illustrates the iron and the copper content for a ductile metal/tungsten mix when the binder is non-metallic. Reference line 96 illustrates that for Cu—Fe—2% (by weight) glass, in excess of about 50% copper may be present while reference line 98 illustrates that when the ductile component is iron, in excess of about 40% iron may be present Reference line 100 illustrates that for Cu—Fe—1% HDPE (by weight), in excess of about 45% copper may be present while reference line 102 illustrates that when the ductile component is iron, in excess of about 37% iron may be present.

From FIGS. 7–10,the following are preferred compositions, in weight percent, when the projectile is to have a density higher than that of lead for enhanced stopping power:

ferrotungsten about 55%–75%;

copper about 20%–40%; and the balance a third component effective as a binder selected from the group consisting of tin, zinc, bismuth and alloys thereof, glasses and polymers.

Ferrotungsten about 68%–85%;

iron about 10%–35%; and the balance a third component effective as a binder selected from the group consisting of tin, zinc, bismuth and alloys thereof, glasses and polymers.

Tungsten about 50%–70%;

copper about 25%–45%; and the balance a third component effective as a binder selected from the group consisting of tin, zinc, bismuth and alloys thereof, glasses and polymers.

Tungsten about 50%–70%;

iron about 20%–40%; and the balance a third component effective as a binder selected from the group consisting of tin, zinc, bismuth and alloys thereof, glasses and polymers.

While the invention has been described with the third component being a low melting temperature metal or metal alloy, non-metals that are fluid at temperatures below about 500° C. and a solid or gel at room temperature are also suitable. Such non-metals could include thermosetting and thermoplastic polymer resins such as epoxies, polyurethanes, polypropylene and polyethylene. Suitable glasses include soda lime glass.

While the first particulate and the second particulate have been described as different materials, it is within the scope of the invention to use the same material for both the first particulate and the second particulate if that single component meets both the requirement of a density greater than 10 g/cm$^3$ and a melting temperature in excess of 1000° C. Such single component materials include molybdenum, tungsten and alloys thereof.

It is apparent that there has been provided in accordance with the invention a lead-free projectile having a lower porosity than achieved by solid state sintering that fully satisfies the objects, means and advantages set forth hereinbefore. While the invention has been described in combination with the embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method for the manufacture of a projectile for discharge from a weapon, comprising the steps of:

blending a mixture of a first particulate, a second particulate and a third particulate where said first particulate has a first room temperature density, said second particulate has a second room temperature density that is lower than the first room temperature density and a melting temperature above 400° C. and said third particulate is a metal that has a melting temperature below the melting temperature of said second particulate wherein said third particulate is added in an amount from that effective to bind said first and second particulate to about 10%, by weight, of said mixture;

compacting said mixture into a mold of a desired shape;

heating said mixture to a temperature greater than the melting temperature of said third particulate, but below the melting temperature of said second particulate, for a time effective to density and consolidate said mixture into a preform; and mechanically forming said preform into said projectile.

2. The method of claim 1 wherein said mold is effective to compact said mixture into the shape of said projectile.

3. The method of claim 1 wherein said mold is effective to compact said mixture into the shape of a cylindrical billet.

4. The method of claim 3 wherein said third particulate is provided to said mixture in an amount of from 3% to 7%, by weight, of said mixture.

5. The method of claim 4 wherein said mechanically forming step includes cutting said cylindrical billet into cylindrical components and then mechanically deforming said cylindrical components to form spherical ballistic shot.

6. A method for the manufacture of a projectile for discharge from a weapon, comprising the steps of:

blending a mixture of a first particulate, a second particulate and a third particulate where said first particulate has a first room temperature density, said second particulate has a second room temperature density that is less than the first room temperature density and a melting temperature above 400° C. and said third particulate has a melting temperature below the melting temperature of said second particulate wherein said third particulate is a metal and added in an amount from that effective to bind said first and second particulate to about 10%, by weight, of said mixture;

delivering said mixture to a first chamber having a first through passageway of a first cross sectional area, said chamber having an open front end;

continuously extruding said mixture through said open front end to a second chamber having a second through passageway of a second cross sectional area that is less than said first cross-sectional area;

heating said mixture to a temperature greater than the melting temperature of said third particulate, but below the melting temperature of said second particulate, for a time effective to density and consolidate said mixture into a rod; and mechanically forming said rod into said projectile.

7. The method of claim 6 wherein said second cross-sectional area is selected to be from 20% to 80%, by area, less than said first cross-sectional area.

8. The method of claim 7 wherein said third particulate is provided to said mixture in an amount of from 3% to 7%, by weight, of said mixture.

9. The method of claim 8 wherein said mechanically forming step includes cutting said rod into cylindrical components and then mechanically deforming said cylindrical components to form spherical ballistic shot.

10. The method of claim 9 wherein a cutting die partitions the rod into said cylindrical components while said rod is at a temperature above the fluidity temperature of said third component.

11. The method of claim 1 wherein the first particulate component, second particulate component and third particulate component are metallic and wherein the heating step including at least one step selected from the group consisting of liquid phase sintering and transient liquid phase sintering.

12. The method of claim 11 wherein the first particulate component consists essentially of ferrotungsten, second particulate component consists essentially of iron and third particulate component consists essentially of zinc.

* * * * *